137-13 SR
C6306 XR 4,549,954

United States Patent [19]

Horton

[11] Patent Number: 4,549,954

[45] Date of Patent: Oct. 29, 1985

[54] POWER RECOVERY SYSTEM FOR COAL LIQUEFACTION PROCESS

[75] Inventor: Joel R. Horton, Maryville, Tenn.

[73] Assignee: The United States of America as represented by the United States Department of Energy, Washington, D.C.

[21] Appl. No.: 257,032

[22] Filed: Apr. 24, 1981

[51] Int. Cl.[4] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,726,784 | 4/1973 | Correa et al. | 208/8 LE |
| 4,119,523 | 10/1978 | Baldwin et al. | 208/8 LE |
| 4,217,112 | 8/1980 | Johnson | 208/8 LE X |
| 4,313,819 | 2/1982 | Rado | 208/8 LE X |

OTHER PUBLICATIONS

"Process Fluid Mechanics", Morton M. Denn, Prentice-Hall, Inc., Englewood Cliffs, New Jersey 07632, pp. 30–32.

"A Flow Work Exchanger, For Desalination Processes", Cheng et al., 8/1968, GPO.

"Development of Flow Work Exchangers for Energy Recovery in Reverse Osmosis Plants", Gilbert, 4/1971, GPO.

*Primary Examiner*—D. E. Gantz

*Assistant Examiner*—William G. Wright

*Attorney, Agent, or Firm*—Edwin D. Grant; Stephen D. Hamel; Judson R. Hightower

[57] ABSTRACT

Method and apparatus for minimizing energy required to inject reactant such as coal-oil slurry into a reaction vessel, using high pressure effluent from the latter to displace the reactant from a containment vessel into the reaction vessel with assistance of low pressure pump. Effluent is degassed in the containment vessel, and a heel of the degassed effluent is maintained between incoming effluent and reactant in the containment vessel.

3 Claims, 8 Drawing Figures

POWER RECOVERY SYSTEM FOR COAL LIQUEFACTION PROCESS

BACKGROUND OF THE INVENTION

This invention, which was made under a contract with the United States Department of Energy, relates in general to a means and method for increasing the energy efficiency of a process such as coal liquefaction. More particularly, the invention relates to a means and method for using energy contained in the effluent from a coal liquefaction reactor to perform most of the work necessary for injecting a reactant fluid into the reactor.

In coal liquefaction processes in which a slurry consisting of coal particles and liquid hydrocarbon compounds is reacted with hydrogen in a reaction vessel at a very high pressure, injection of the slurry into the reaction vessel has heretofore required the use of high pressure differential pumps that use a large amount of energy. The combination of high pressure and the abrasive nature of the reactant slurry also causes rapid deterioration of the charging pumps, which are inconvenient and costly to replace.

SUMMARY OF THE INVENTION

It is an object of this invention to provide a fluid-flow system wherein a fluid effluent containing vaporizable constituents supplies a portion of the energy required for injecting a reactant into a high-pressure reaction vessel.

Another object of the invention is to minimize the use of rapidly wearing, high-pressure differential pumps for injecting an abrasive slurry of coal and oil into a coal liquefaction reaction vessel.

Another object of the invention is to improve the efficiency of a coal liquefaction process by using a parallel arrangement of chambers in which gas is separated from hydrogenation products of the process as a means for pressurizing a coal/oil slurry injected into the liquefaction vessel.

In accordance with a preferred process embodiment of the invention, these objects and other advantages are achieved by the following operations:

(1) introducing effluent discharged at a high pressure from a reaction vessel into a containment vessel having an inlet and an outlet for a reactant material that is hydrogenated in said reaction vessel, said effluent containing vaporizable constituents and its introduction into the containment vessel at essentially the pressure of the reaction vessel forcing reactant material from the containment vessel to a low pressure head pump connected to the reaction vessel;

(2) terminating flow of said effluent into said containment vessel;

(3) discharging a portion of effluent from said containment vessel to reduce the pressure therein to a sufficiently low value to permit the evolution of the vaporizable constituents from effluent in the containment vessel;

(4) releasing evolved vaporizable constituents from the containment vessel;

(5) introducing additional reactant material into said containment vessel and terminating flow of effluent from said containment vessel, gas continuing to flow from said containment vessel as reactant material enters the vessel; and (6) sequentially repeating the above steps with a heel of degassed effluent being maintained in the containment vessel between the effluent entering the containment vessel and the reactant material therein.

DETAILED DESCRIPITON OF THE PREFERRED EMBODIMENT OF THE INVENTION

Figure 1:
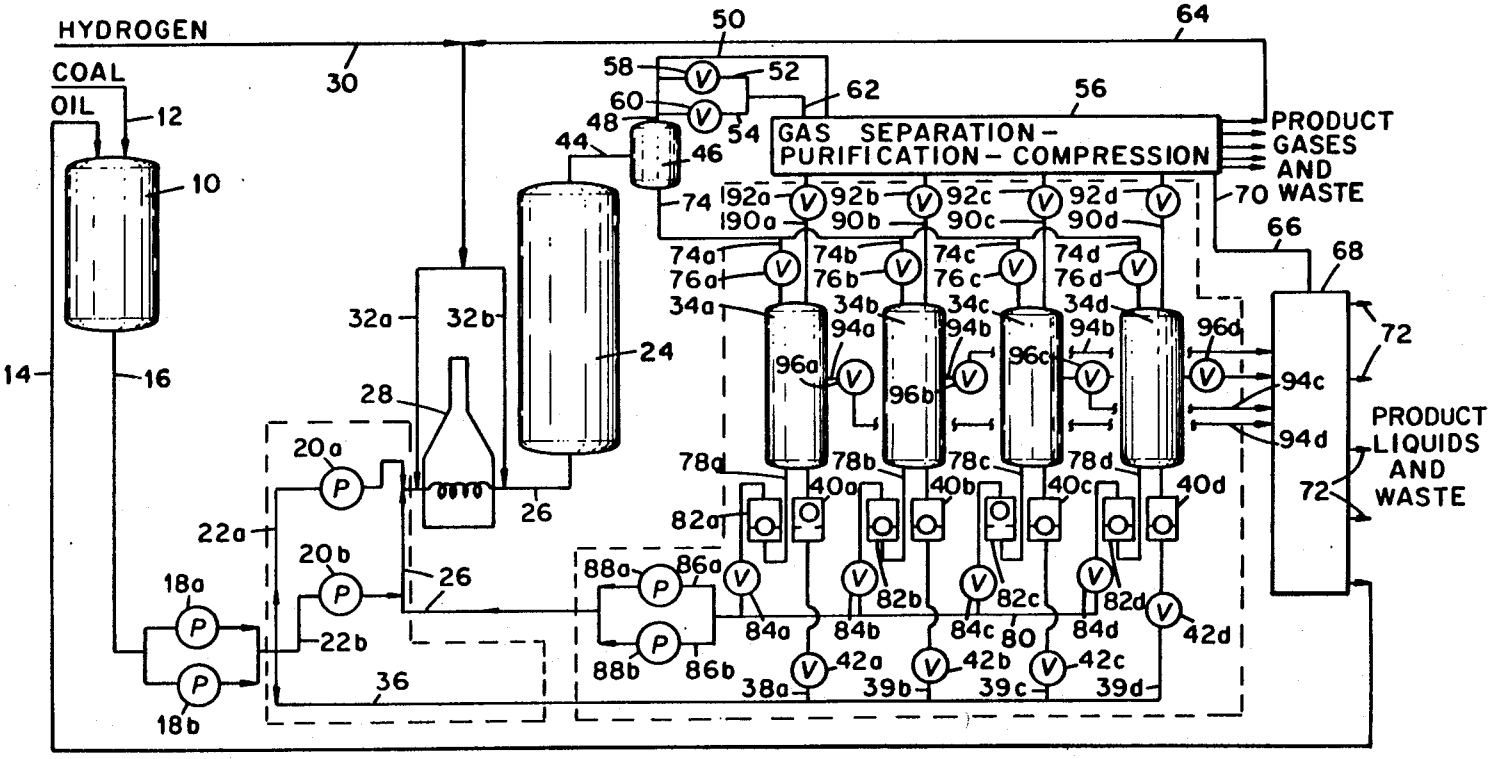
FIG. 1 is a schematic representation of a preferred apparatus embodiment of the invention.

In FIG. 1 reference number 10 designates a slurry mixing tank having two inlet conduits 12, 14 and an outlet conduit 16 connected therewith. Conduit 16 branches into two conduits respectively connected to two low-pressure differential centrifugal pumps 18*a*, 18*b*. The outlets of these pumps connect with two high-pressure differential reciprocating pumps 20*a*, 20*b* through conduits 22*a*, 22*b*, and the outlets of the last-mentioned pumps connect with the lower portion of a reaction vessel 24 through a conduit 26 that passes through a heater 28. A hydrogen feed conduit 30 branches into two conduits 32*a*, 32*b* that respectively connect with conduit 26 on opposite sides of heater 28. Pumps 18*a*, 18*b* also connect with four cylindrical, vertically oriented containment vessels 34*a*–34*d* through a main conduit 36 and branch conduits 38*a*–38*d*, each of the latter having a check valve 40*a*–40*d* and a second valve 42*a*–42*b* associated therewith for controlling fluid flow therethrough. Flow through conduits 12, 14 and pumps 18, 20 is also controlled by means of valves that are not illustrated to simplify the drawing.

An effluent conduit 44 extends from the top of reaction vessel 24 to the middle portion of a gas separator 46. A gas outlet conduit 48 is connected to the top of separator 46 and branches into three conduits 50, 52, 54. Conduit 50 is directly connected to an apparatus 56 that further separates, purifies, and compresses gas separated in separator 46. Conduits 52 and 54 have valves 58, 60, respectively, associated therewith and unite with a conduit 62 that is also connected with apparatus 56. A hydrogen feed conduit 64 extends from apparatus 56 to conduit 30, and a liquid outlet conduit 66 extends from the same apparatus to a means 68 for separating liquid from solid waste material. Product gases and waste gases are also discharged from apparatus 56 through conduits 70, and product liquids and solid waste materials flow from the separation means 68 through conduits 72.

An effluent conduit 74 connects with the lower portion of separation vessel 46 and branches into four conduits 74*a*–74*d* which are each provided with a flow control valve 76*a*–76*d* and which respectively connect with the upper portions of containment vessels 34*a*–34*d*. Conduits 78*a*–78*d* are respectively connected to the lower portions of containment vessels 34*a*–34*d* and to a conduit 80, with a check valve 82*a*–82*d* and a second valve 84*a*–84*d* being respectively associated with the conduits 78*a*–78*d*. Conduit 80 divides into conduits 86*a*, 86*b* which are respectively connected to low-pressure differential centrifugal pumps 88*a*, 88*b*, and the outlets of these pumps connect with conduit 26.

Vent conduits 90*a*–90*d* provided with flow control valves 92*a*–92*d* are respectively connected to the upper portions of containment vessels 34a–34d and to the gas-processing apparatus 56. Lastly, four output conduits 94a–94d provided with valves 96a–96d are respectively connected to containment vessels 34a–34d intermediate the upper and lower portions thereof and to the liquid-solid separation means 68.

OPERATION OF THE PREFERRED EMBODIMENT OF THE INVENTION

Part of the oil obtained from the coal liquefaction process of this invention is recycled from the liquid-solid separation means 68 to mixing vessel 10 through conduit 14 during the continuous operation of the system. Pulverized coal enters vessel 10 through conduit 12 and is mixed therein with the product oil to form a slurry that passes through conduit 16 to one of the low-pressure differential pumps 18a, 18b, the other pump serving as a spare. From the operating pump 18a or 18b part of the slurry flows to one of the high-pressure differential pumps 20a, 20b (the other of these pumps also being a spare) and then through heater 28 to reaction vessel 24 via conduit 26. Gaseous hydrogen is introduced into the slurry by means of conduits 32a, 32b, part of this hydrogen being recycled from separation apparatus 56 through conduit 64 and the remainder being supplied from a separate conduit 30. In reaction vessel 24 coal in the slurry is hydrogenated by the hydrogen gas to produce liquid and gaseous hydrocarbon products discharged from the reaction vessel through conduit 44 along with unreacted coal. In certain of the claims appended hereto, the coal-oil slurry mixed in vessel 10 is referred to as the "first reactant," the hydrogen injected into the slurry is referred to as the "second reactant," the operating pump 20a or 20b and conduit 26 are referred to as the "first conduit means and high-pressure differential pump means" for feeding a portion of said first reactant to the reaction vessel, and conduits 32a, 32b are referred to as the "second conduit means" for feeding said second reactant to the reaction vessel.

After the described apparatus has been regulated to its final continuous mode of operation, most of the slurry discharged from the operating low-pressure differential pump 18a or 18b is successively pumped to the three containment vessels 34a–34c, the other vessel 34d serving as a spare. The operation of the apparatus will be described hereinafter with respect to both startup flow of materials and the final sequential flow of slurry to containment vessels 34a–34c. In certain of the claims appended hereto, conduit 36 and the operating pump 18a or 18b are referred to as the "third conduit means and low-pressure differential pump means" for feeding the first reactant (i.e., the coal-oil slurry) to a containment vessel.

A portion of the gas in the effluent from reaction vessel 24 is separated from the liquid and solid effluent constituents in separator 46 and passes to apparatus 56 through conduits 50 and 62. The remainder of the effluent is conducted to containment vessels 34a–34c sequentially when the described material processing system is operating in accordance with the preferred process embodiment of the invention, and in each containment vessel, gas is again separated from other effluent constituents by operations that will be described with reference to FIGS. 2 through 8.

Figure 2:
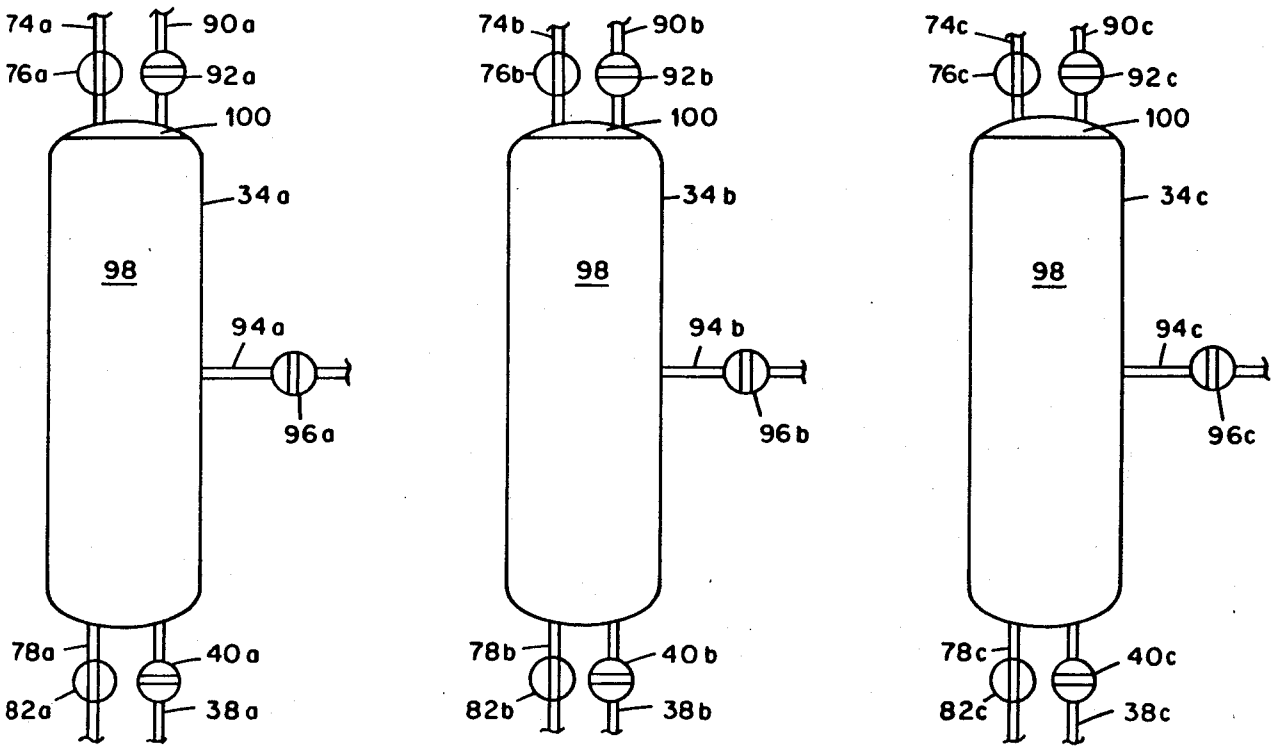
FIGS. 2 through 8 illustrate the different operational settings of valves which control the flow of materials into and out of three vessels included in the apparatus of FIG. 1.

To simplify the drawings, the check valves 40a–40c shown in FIG. 1 are replaced in FIGS. 2–8 by schematically represented rotatable valves. Many suitable types of valves can be used to control fluid flow in the described apparatus; however, check valves 40a–40c and 82a–82c open and close in response to the pressure in containment vessels 34a–34c and thus simplify the operation of the system. FIG. 2 illustrates the arrangement of valves associated with containment vessels 34a–34c during the startup phase of operation of the system of the invention. As containment vessel 34d is a spare, its inlet and outlet valves are closed and the vessel is not illustrated in FIGS. 2 through 8. Valves 42a–42c, 84a–84c (which are illustrated only in FIG. 1 and are included in the respective conduits 38a–38d and 78a–78d only for use in isolating any one of the four containment vessels 34a–34d from the system) and valves 76a–76c, 82a–82c are open, and valves 40a–40c, 92a–92b, 96a–96c are closed. Hydrogenation of coal in reaction vessel 24 occurs under high pressure (for example, in some processes 2,100 psia). Thus the reaction vessel effluent, which consists of a mixture of unreacted coal particles, oil and gas, enters gas separator 46 at a pressure substantially equal to the pressure in the reaction vessel. Even after part of the gas in the reaction vessel effluent is removed in separator 46, the effluent fed to containment vessels 34a–34c through conduits 74 and 74a–74c remains at a high pressure and during the presently described startup phase of operation flows through the containment vessels to the operating pump 88a or 88b (as previously mentioned, one of the pumps 88a, 88b is a spare) and thence through conduit 26 to reaction vessel 24. Reference number 98 designates gas-containing reaction vessel effluent in containment vessels 34a–34c during the effluent recycling phase of the startup procedure for the system, and reference number 100 designates gas evolved from this effluent because of the small pressure drop in the containment vessels at this time.

Figure 3:
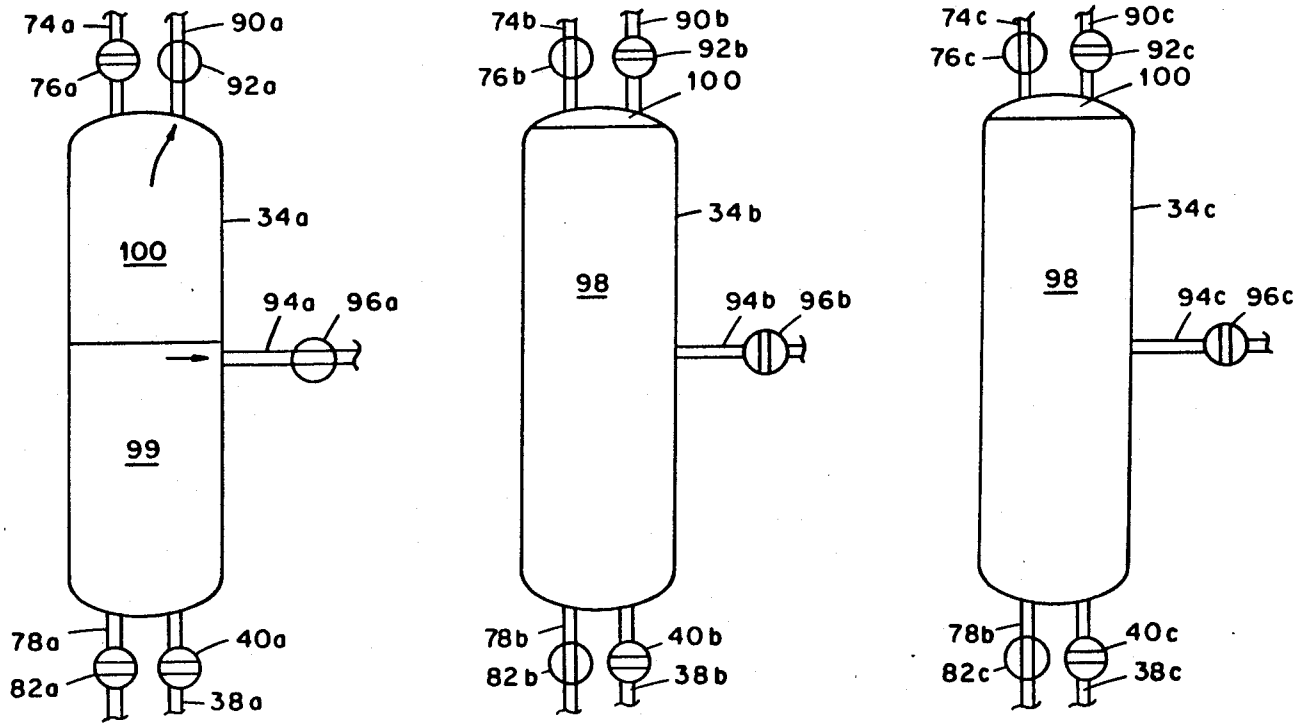

The flow arrangement of valves associated with containment vessel 34a is next changed while the valves for the other two operating containment vessels are left in the settings illustrated in FIG. 2. As illustrated in FIG. 3, valves 76a and 82a are adjusted from open to closed position, valve 40a is left in closed position, and valve 96a is opened so that reaction vessel effluent flows from containment vessel 34a through output conduit 94a to the solid-liquid separation means 68, which operates at a much lower pressure than the containment vessel. This flow of effluent through output conduit 94a causes a drop in pressure in containment vessel 34, which results in a substantial increase in the amount of gas 100 evolved from effluent 98 in the containment vessel. After the level of reactor vessel effluent in containment vessel 34a has dropped sufficiently to preclude flow of effluent through vent conduit 90a, valve 92a is opened, which causes a further drop in pressure in the containment vessel since the pressure in the gas separation portion of apparatus 56 is also lower than the containment vessel pressure. Gas 100 evolving from the reaction vessel effluent in containment vessel 34a passes through vent conduit 90a to apparatus 56. Reactor vessel effluent from which gas has been removed in the containment vessel 34a is designated by reference number 99 in FIG. 3, and the reference number 98 used for gas-containing effluent in FIG. 2 and the reference number 99 used for degassed effluent in FIG. 3 will be used throughout FIGS. 4 through 8 for the same materials in each containment vessel. The small amount of reaction vessel effluent which flows from containment vessel 34a to the solid-liquid separation means 68 before valve 92a is opened contains more gas than will be present in effluent discharged from the containment vessels after the startup phase of operation has been completed. After the startup period of operation, effluent discharged to means 68 will contain a minimal concentration of gas, depending upon various process parameters such as the extent of pressure drop in the containment vessels, the duration of the effluent exposure to the pressure drop in the containment vessels, and the rate of pressure drop.

For the purpose of identification, effluent from which gas has been permitted to evolve in one of the containment vessels 34*a*–34*c*, (assuming these three vessels are being used in the process) will be referred to as degassed effluent, even though a small amount of gas may still be dissolved in the effluent.

Figure 4:
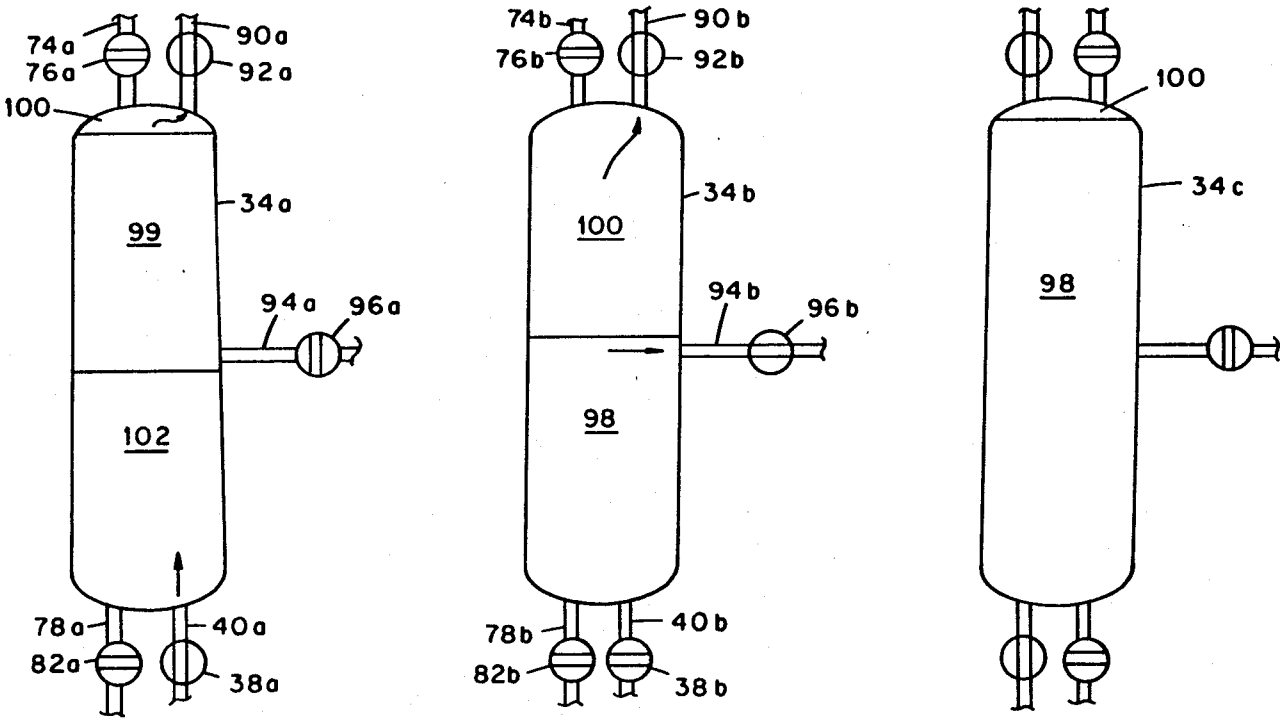

In the next operational stage illustrated in FIG. 4, the flow-control valves for containment vessel 34*b* are adjusted to correspond with the FIG. 3 arrangement of the flow-control valves for containment vessel 34*a*, while the flow-control valves for containment vessel 34*c* are left in the arrangement illustrated in FIG. 2. When the level of reaction vessel effluent in containment vessel 34*a* has dropped to a point just above the outlet for output conduit 94*a* (as illustrated in FIG. 3), valves 96*a* is closed as illustrated in FIG. 4 and valve 40*a* is opened. Valves 76*a* and 82*a* are kept closed and valve 92*a* is kept open. Slurry identified by reference number 102 is then pumped into containment vessel 34*a* by the operating pump 18*a* or 18*b* via conduits 36*b* and 38*a*, and this slurry lifts the degassed effluent 99 remaining in containment vessel 34*a*, gas 100 above the effluent being simultaneously vented through vent conduit 90*a*.

Figure 5:
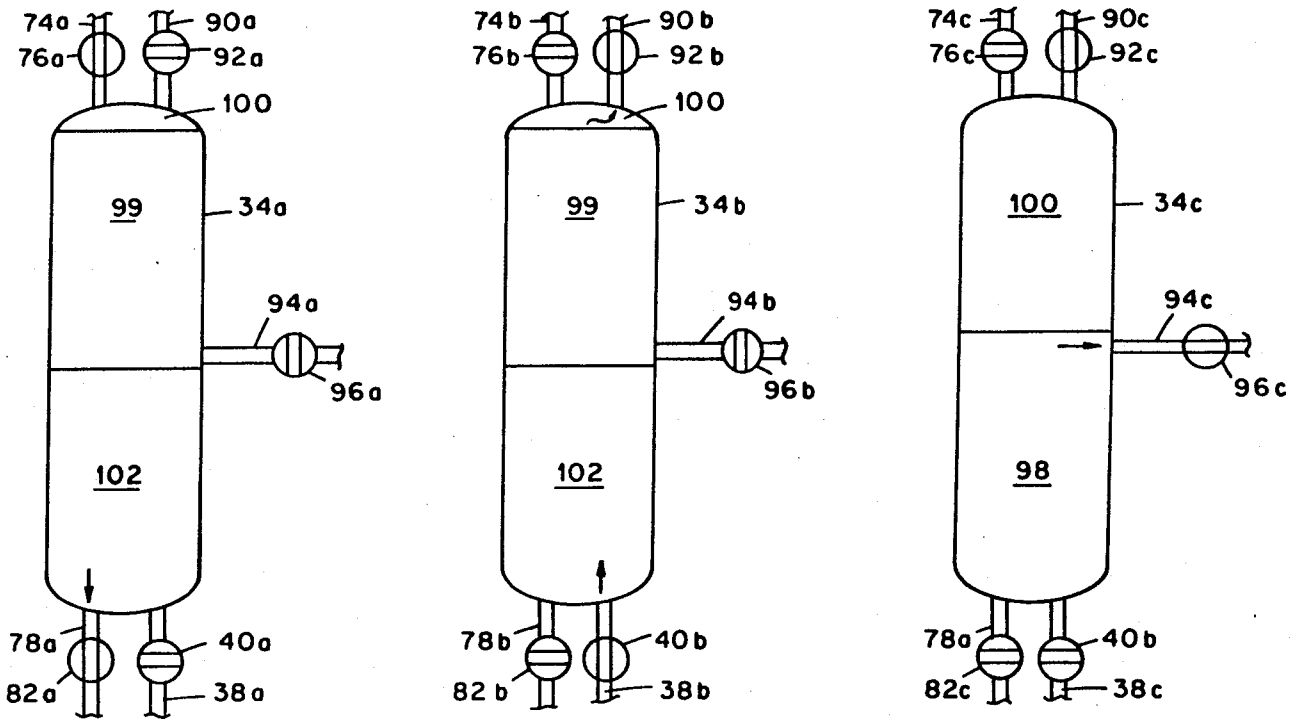

When the level of degassed reaction vessel effluent 99 reaches the upper portion of containment vessel 34*a* as illustrated in FIG. 4, the flow-control valves for containment vessel 34*a* are adjusted to the settings illustrated in FIG. 5, wherein valves 76*a* and 82*a* are changed from closed to open position, valves 40*a* and 92*a* are changed from open to closed position, and valve 96*a* remains closed. The settings of flow-control valves for containment vessel 34*b* are adjusted to correspond with the FIG. 4 arrangement of flow-control valves for containment vessel 34*a*, and the settings of flow-control valves for containment vessel 34*c* are adjusted to correspond with the FIG. 3 arrangement of flow control valves for containment vessel 34*b*. The adjustments of the flow-control valves for containment vessels 34*b* and 34*c* will now follow the adjustments of the flow-control valves for containment vessel 34*a* in the same sequential order (i.e., the same process steps will occur in the containment vessels but at different times), and hence the settings of valves for containment vessels 34*b* and 34*c* will not be further described. The high-pressure, gas-containing effluent entering containment vessel 34*a* through the open valve 76*a* forces degassed effluent 99 downwardly, and the degassed effluent in turn displaces slurry 102 from the containment vessel through open valve 82*a* to low-pressure differential pump 88*a* or 88*b* which assists in forcing the slurry through conduit 26 and into reaction vessel 24. In certain claims appended hereto, conduits 26 and 78*a* and pump 88*a* or 88*b* are referred to as the "fourth conduit means and low-pressure differential pump means" for feeding the first reactant (i.e., slurry 102) from the lower portion of containment vessel 34*a* to reaction vessel 24.

Figure 6:
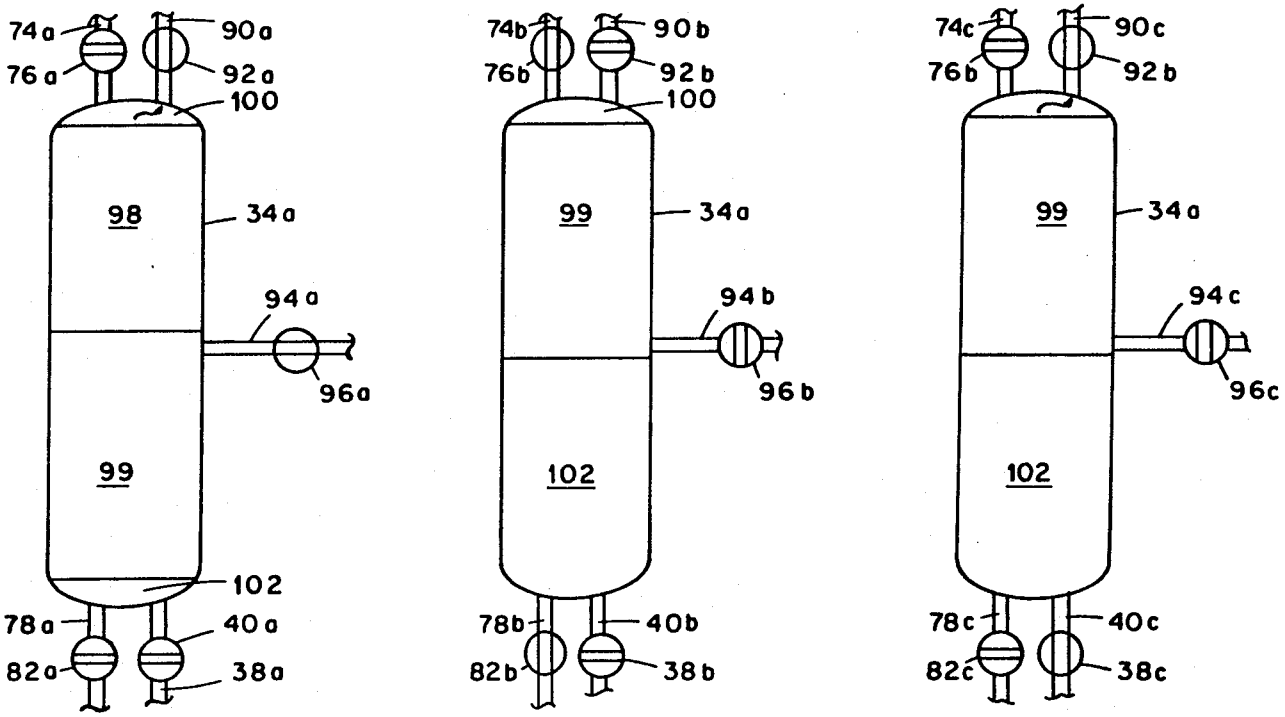

When the level of slurry 102 in containment vessel 34*a* reaches the lower portion of the vessel and the interface between the gas-containing effluent 98 just introduced into the vessel and the degassed heel of effluent 99 in the vessel has reached a point near (i.e., slightly above, even with, or slightly below) output conduit 94*a*, valve 96*a* is opened and valve 82*a* is closed, as illustrated in FIG. 6. Shortly thereafter, depending on the pressure drop in the vessel resulting from the opening of valve 96*a*, valve 92*a* is opened (as also illustrated in FIG. 6), valve 40*a* being left in closed position. Gas 100 thus evolves from gas-containing effluent 98 and flows from the vessel through vent conduit 90*a* as soon as valve 92*a* is opened.

Figure 7:
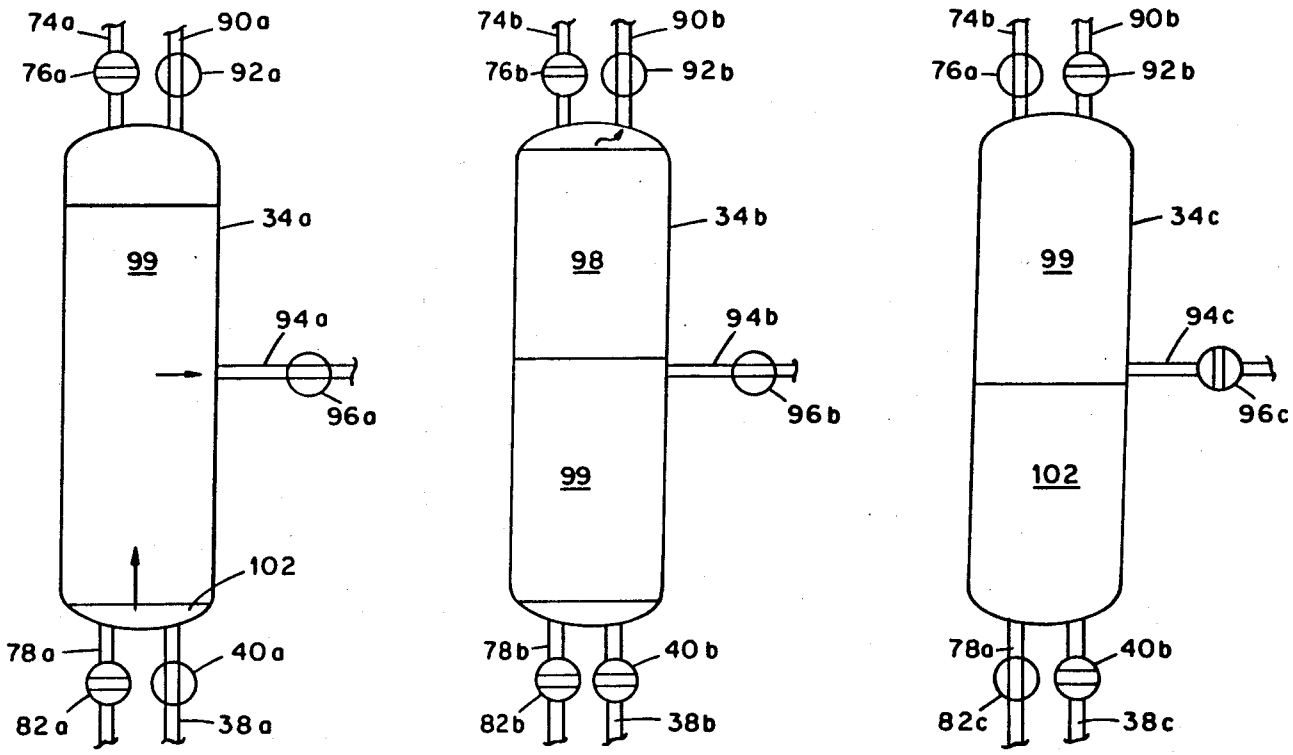

After gas has evolved from effluent 98 in containment vessel 34*a* as described in the preceding paragraph, the vessel is mainly filled with degassed effluent 99 as illustrated in FIG. 7. Valve 40*a* is then opened, valves 92*a* and 96*a* are kept open, and valves 76*a* and 82*a* are kept closed, as also illustrated in FIG. 7. Slurry 102 is therefore permitted to flow into containment vessel 34*a* from the operating pump 18*a* or 18*b*, forcing degassed effluent 99 from the containment vessel through valve 96*a* to the solid-liquid separation means 68 (the direction of movement of the interface between degassed effluent 99 and slurry 102 is represented by an arrow in FIG. 7).

Figure 8:
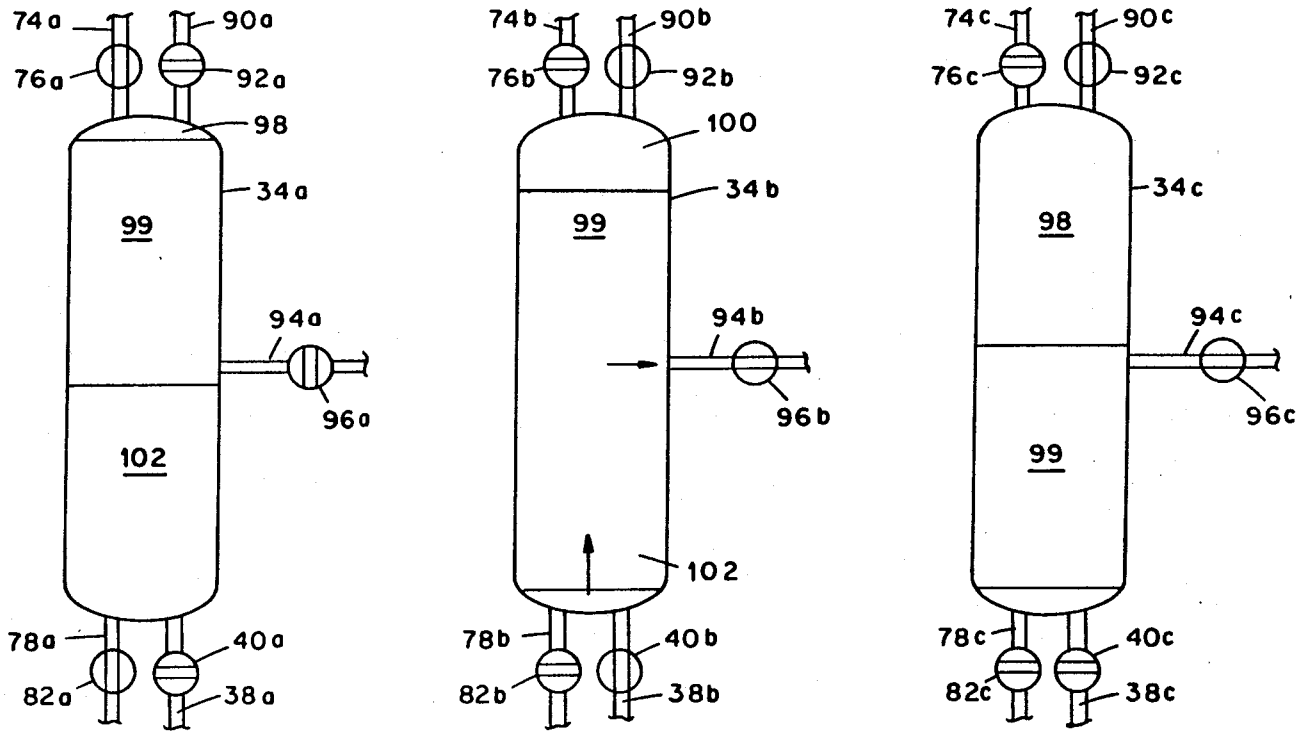

When the level of slurry 102 in containment vessel 34*a* reaches a point just below the outlet of output conduit 94*a*, valves 92*a* and 96*a* are closed and valves 76*a* and 82*a* are opened, as illustrated in FIG. 8, but valve 92*a* may be closed earlier if effluent 99 reaches the upper portion of containment vessel 34*a* before the level of slurry 102 reaches the aforesaid point. Likewise valve 96*a* may be closed earlier if required in order to displace most of gas 100 from containment vessel 34*a* before the slurry 102 in the containment vessel reaches a point just below the outlet of output conduit 94*a*. Valves for containment vessel 34*a* are thereby placed in the same settings illustrated in FIG. 5. The changes of the valves settings for the three containment vessels 34*a*–34*c* are then repeated in the sequential steps illustrated in FIGS. 5 through 8.

Some mixing occurs between gas-containing reaction vessel effluent entering containment vessels 34*a*–34*c* through conduits 76*a*–76*c* and the heels of degassed effluent 99 remaining in the vessels after the initial steps required to place the system in the sequence of operation illustrated in FIGS. 5 through 8. Also some mixing occurs between the heels of degassed effluent and the slurry 102 entering containment vessels 34*a*–34*c* through conduits 38*a*–38*c*. However, recycle of degassed effluent 99 to reaction vessel 24 does not adversely affect the hydrogenation of coal in the reaction vessel, and any coal particles included in slurry 102 which may pass with degassed effluent from containment vessels 34*a*–34*c* through conduits 94*a*–94*c* will be separated from liquid products in the liquid-solid separation means 68. If desired, baffles can be placed in the containment vessels to reduce mixing of the degassed effluent 99 with successive charges of gas-containing effluent 98 and slurry 102.

When containment vessels 34*a*–34*c* are operating in the sequence illustrated in FIGS. 5 through 8, effluent from reaction vessel 24 successively displaces slurry 102 from containment vessels 34*a*–34*c* to the operating pump 88*a* or 88*b* at high pressure. The pump 88*a* or 88*b* therefore only assists in the injection of slurry into reaction vessel 24 and can be a low-head type pump which uses less energy and is less susceptible to wear than the high pressure differential pumps normally required for injecting coal/oil slurry into the reaction vessel of coal liquefaction apparatus.

What is claimed is:

1. A method for minimizing energy required for pumping a reactant into a reaction vessel wherein said reactant is reacted at high pressure to form a liquid product containing vaporizable constituents, comprising the following steps in the sequence set forth:

(1) introducing said reactant into a containment vessel;

(2) passing said liquid product, at essentially the pressure in said reaction vessel, from said reaction vessel into said containment vessel to thereby displace reactant from the containment vessel to a pumping means, pressurizing the reactant at said pumping means to a pressure higher than the pressure in said reaction vessel, and then passing the pressurized reactant from said pumping means into said reaction vessel;

(3) terminating flow of said liquid product from said reaction vessel into said containment vessel;

(4) discharging a portion of said liquid product from said containment vessel to thereby reduce pressure in the latter to a sufficiently low value to effect evolution of vaporizable constituents from liquid product remaining in the containment vessel;

(5) releasing the evolved constituents from said containment vessel; and (6) sequentially repeating steps 1 through 5.

2. The method of claim 1 wherein a heel of degassed liquid product is maintained between fresh liquid product and reactant introduced into said containment vessel as steps 1 and 5 are repeated.

3. The method of claim 2 wherein;

said reactant comprises a slurry of coal particles mixed with a hydrocarbon liquid; and hydrogen is reacted with said slurry in said reaction vessel to form said liquid product.

* * * * *